United States Patent [19]

Adam et al.

[11] Patent Number: 4,957,847

[45] Date of Patent: Sep. 18, 1990

[54] HEAT-SENSITIVE CYCLIC DIAZO COMPOUND CONTAINING RECORDING MATERIAL WITH BENZOTRIAZINE COMPOUND AND COUPLING COMPONENT

[75] Inventors: Jean-Marie Adam, Rosenau, France; Hans Baumann, Oberwil, Switzerland

[73] Assignee: Ciba-Geigy Corporation, Ardsley, N.Y.

[21] Appl. No.: 278,989

[22] Filed: Dec. 2, 1988

[30] Foreign Application Priority Data

Dec. 11, 1987 [CH] Switzerland ..... 4849/87

[51] Int. Cl.[5] ..... G03C 1/52; G03C 1/58; B41M 5/30

[52] U.S. Cl. ..... 430/170; 430/141; 430/151; 430/176; 430/177; 430/178; 430/179; 430/180; 430/181; 430/182; 430/155; 503/200; 503/218

[58] Field of Search ..... 430/170, 141, 151, 180, 430/182, 155; 503/200, 218

[56] References Cited

U.S. PATENT DOCUMENTS

| | | | |
|---|---|---|---|
| 2,402,611 | 6/1946 | Dickey et al. | 260/243 |
| 2,411,811 | 11/1946 | Sargent | 430/171 |
| 2,537,097 | 1/1951 | Slifkin | 430/171 |
| 2,758,115 | 8/1956 | Lorenz et al. | 260/248 |
| 2,798,055 | 7/1957 | Sullivan | 260/2.5 |
| 2,834,764 | 5/1958 | Thomas et al. | 260/85.5 |
| 2,843,588 | 7/1958 | Lorenz | 260/248 |
| 4,487,826 | 12/1984 | Watanabe et al. | 430/151 |
| 4,598,035 | 7/1986 | Usami et al. | 430/151 |
| 4,665,411 | 5/1989 | Kiritani et al. | 430/151 |

OTHER PUBLICATIONS

Sato, Hirotsugu et al., "UV-Fixable Thermal Recording Paper", *J. of Imaging Technology*, vol. 11, No. 3, 6/1985, pp. 137–142.

Kosar, J., Light-Sensitive Systems, J. Wiley & Sons, 1965, pp. 259–267.

*Primary Examiner*—Charles L. Bowers, Jr.

*Attorney, Agent, or Firm*—Kevin T. Mansfield; George R. Dohmann

[57] ABSTRACT

A heat-sensitive recording material comprising a base and, on top of the said base, a heat-sensitive layer containing a cyclic diazo component and a coupling component, the cyclic diazo component being a benzotriazine compound of the formula

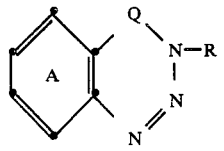

(1)

wherein Q is —$CH_2$—, —CO— or —$SO_2$—, R is hydrogen, hydroxyl, or aryl or alkenyl, each unsubstituted or substituted by halogen, hydroxyl, cyano, lower alkoxy, lower alkylthio, acyloxy, lower alkoxycarbonyl or lower alkylsulfonyl, or is acyl, acyloxy or acylamino, cycloalkyl, or is aryl or aralkyl such as phenyl, phenylalkyl or naphthyl each unsubstituted or substituted on the ring by cyano, halogen, nitro, trifluoromethyl, lower alkyl, lower alkylthio, lower alkoxy, lower alkylcarbonyl or lower alkoxycarbonyl, or is a heterocyclic radical, and the benzene ring A is unsubstituted or substituted by halogen, cyano, nitro, lower alkyl, lower alkoxy, lower alkylthio, lower alkylcarbonyl or lower alkoxycarbonyl.

10 Claims, No Drawings

HEAT-SENSITIVE CYCLIC DIAZO COMPOUND CONTAINING RECORDING MATERIAL WITH BENZOTRIAZINE COMPOUND AND COUPLING COMPONENT

The present invention relates to a heat-sensitive recording material comprising a support and, on top of the said support, a heat-sensitive layer containing a cyclic diazo component and a coupling component, wherein the cyclic diazo component is a benzotriazine compound of the formula

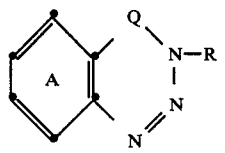

(1)

wherein Q is —$CH_2$—, —CO— or —$SO_2$—, R is hydrogen, hydroxyl, alkyl or alkenyl having at most 12 carbon atoms each unsubstituted or substituted by halogen, hydroxyl, cyano, lower alkoxy, lower alkylthio, $C_1$–$C_8$-acyloxy, lower alkoxycarbonyl or lower alkylsulfonyl, or is acyl, acyloxy or acylamino, each having 1 to 10 carbon atoms, cycloalkyl having 5 to 10 carbon atoms, or phenyl, phenylalkyl or naphthyl each unsubstituted or substituted on the ring by cyano, halogen, nitro, trifluoromsthyl, lower alkyl, lower alkylthio, lower alkoxy, lower alkylcarbonyl or lower alkoxycarbonyl, or is a heterocyclic radical, and the benzene ring A is unsubstituted or substituted by halogen, cyano, nitro, lower alkyl, lower alkoxy, lower alkylthio, lower alkylcarbonyl or lower alkoxycarbonyl.

In the definition of the radicals of the benzotriazines, lower alkyl, lower alkoxy and lower alkylthio are groups or parts of groups having 1 to 5, in particular 1 to 3, carbon atoms. Examples of such groups are methyl, ethyl, n-propyl, isopropyl, n-butyl, sec-butyl, amyl or isoamyl, methoxy, ethoxy, isopropoxy, isobutoxy or tert-butoxy, and methylthio, ethylthio, propylthio or butylthio.

Halogen is, for example, fluorine, bromine or preferably chlorine The term "acyl" in acyl, acyloxy and acylamino is especially formyl, lower alkylcarbonyl, for example acetyl or propionyl, or benzoyl. Other acyl radicals or acyl moieties can be lower alkylsulfonyl, for example methylsulfonyl or ethylsulfonyl, or phenylsulfonyl. Benzoyl and phenylsulfonyl can be substituted by halogen, methyl, methoxy or ethoxy.

Q is advantageously —CO— or preferably —$SO_2$—.

R as alkyl and alkenyl radicals can be linear or branched, examples being methyl, ethyl, n-propyl, isopropyl, n-butyl, sec-butyl, tertbutyl, 1,1,3,3-tetramethylbutyl, amyl, isoamyl, n-hexyl, 2-ethylhexyl, n-heptyl, n-octyl, isooctyl, n-nonyl, isononyl or n-dodecyl, and vinyl, allyl, 2-methallyl, 2-ethylallyl or but-2-enyl.

R as a substituted alkyl radical is, in particular, cyanoalkyl, halogenoalkyl, hydroxyalkyl, alkylthioalkyl, alkoxyalkyl, alkylsulfonyloxyalkyl or alkoxycarbonylalkyl, preferably with a total of 1 to 8, 2 to 8 or 3 to 8 carbon atoms in each case, for example cyanomethyl, β-cyanoethyl, chloromethyl, β-chloroethyl, hydroxymethyl, β-hydroxyethyl, carbomethoxymethyl, β-methoxyethyl, β-ethoxyethyl, γ-methoxypropyl, methoxybutyl or methylsulfonyloxyethyl. R as an aliphatic radical of this type can also be interrupted several times by oxygen atoms or sulfur atoms.

Examples of R as cycloalkyl are cyclopentyl, cycloheptyl or preferably cyclohexyl. The cycloalkyl radicals can contain one or more $C_1$–$C_4$-alkyl radicals, preferably methyl groups, and they have a total of 5 to 10 carbon atoms.

R as phenylalkyl advantageously has a total of 7 to 9 carbon atoms and is generally α-methylbenzyl, phenethyl, phenisopropyl or especially benzyl, which can preferably also be ring-substituted.

Examples of preferred substituents in the benzyl group and in the phenyl group are halogen, methyl or methoxy. Examples of such araliphatic or aromatic radicals are 2,5-dimethylbenzyl, 2,6-dimethylphenyl, o- or p-tolyl, xylyl, o-, m- or p-chlorophenyl, o- or p-methoxyphenyl, o- or p-chlorobenzyl or o- or p-methylbenzyl.

R as a heterocyclic radical is especially a 5- or 6-membered heterocycle of aromatic character, preferably containing oxygen, sulfur or nitrogen. Examples of such heterocycles are thienyl, furyl, furfuryl, pyrrolyl, pyrazolyl, imidazolyl or pyridyl radicals.

R can also be a polynuclear heterocyclic ring system preferably containing a fused benzene or naphthalene ring, for example a substituted or unsubstituted benzothiophene, indolyl, benzothiazolyl, coumarin, quinoline or carbazolyl radical. The mononuclear or polynuclear heterocyclic radicals can be substituted, in particular by halogen, hydroxyl, cyano, nitro, lower alkyl, lower alkoxy or lower alkoxycarbonyl. R as a heterocyclic radical is preferably 2-furyl, furfuryl, tetrahydrofurfuryl, 2-thienyl, 2-, 3- or 4-pyridyl or 5-lower alkoxycarbonyl-2-thienyl, for example 5-carbomethoxy-2-thienyl.

The substituent R is preferably lower alkyl, for example methyl, ethyl or butyl, hydroxy-lower alkyl, for example hydroxymethyl or hydroxyethyl, cyano-lower alkyl, for example cyanomethyl or cyanoethyl, acetyl, acetylamino, benzoyl, cyclohexyl, benzyl, phenyl, chlorophenyl, tolyl, xylyl, 2,6-dimethylphenyl, naphthyl, methoxyphenyl, pyridyl or furfuryl.

The benzene ring A is preferably unsubstituted. However, it can have 1 to 4 (preferably 1 or 2) substituents, preferred substituents being halogen, nitro, lower alkyl, lower alkoxy or lower alkoxycarbonyl.

Cyclic diazo components of practical importance have the formula

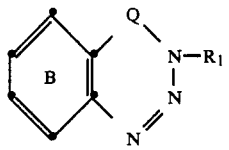

(2)

wherein Q is —CO— or preferably —$SO_2$—, $R_1$ is lower alkyl, halogeno-lower alkyl, hydroxy-lower alkyl, cyano-lower alkyl, lower alkoxycarbonyl-lower alkyl, cyclohexyl, benzyl, naphthyl, phenyl which is unsubstituted or substituted by halogen, cyano, nitro, lower alkyl, lower alkoxy, trifluoromethyl or lower alkylcarbonyl, or a heterocyclic radical of aromatic character, and the benzene ring B is unsubstituted or substituted by halogen, nitro, lower alkyl, lower alkoxy or lower alkoxycarbonyl.

The preferred cyclic diazo components of formula (2) are those in which the benzene ring B is unsubstituted or substituted by halogen and $R_1$ is lower alkyl, cyclohexyl, benzyl or phenyl which is unsubstituted or substituted by halogen, lower alkyl or lower alkoxy.

Of particular interest are cyclic diazo components of the formula

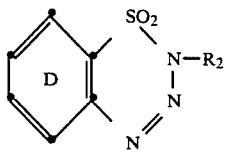

(3)

wherein $R_2$ is lower alkyl, cyclohexyl, benzyl, phenyl or phenyl substituted by halogen, methyl or methoxy, and the benzene ring D is unsubstituted or substituted by halogen.

Of principal interest are N-methylbenzothiatriazine, N-n-butylbenzothiatriazine, N-cyclohexylbenzothiatriazine, N-benzylbenzothiatriazine and N-phenylbenzothiatriazine.

The cyclic diazo component of formula (1) can be prepared by diazotizing and cyclizing an amino compound of the formula

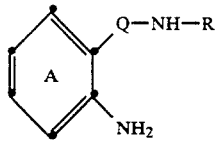

wherein A, Q and R are as defined above.

Cyclic diazo components of formulae (1) to (3) and their preparation are described, for example, in U.S. Pat. Nos. 2,834,764, 2,402,611, 2,798,055, 2,843,588 and 2,758,115. Other literature references are A. C. Mair and M. F. G. Stevens, J. Chem. Soc. C 1971, 2317, Helv. Chimica Acta 68. 892 (1985), J. Am. Chem. Soc. 77, 6562 (1955), and J. Pr. Chemie [2], 51, (1895), 113, 132, 260, 277 and 280, 52, (1896), 379, 385, 393 and 405, 55. (1897), 356, and 71. (1905), 153.

Possible coupling components are any of those known from the relevant literature and conventionally used in azo chemistry, provided they do not contain any acid groups conferring solubility in water, for example carboxyl and sulfonic acid groups.

Examples of the many possibilities are: coupling components of the benzene series or of the naphthalene series, open-chain compounds with active methylenes, and coupling components of the heterocyclic series.

Examples of the said coupling components are acylacetarylamides, phenols, anilines, naphthylamines, diphenylamines, naphthols, naphtholcarboxylic acid anilides, aminopyrazoles, pyrazolones, thiophenes, aminothiazoles, hydroxypyridines, pyridones, indoles, quinolones, barbituric acids or hydroxyquinolines.

Especially preferred coupling components are naphthols, naphtholcarboxylic acid anilides and acylacetarylamides, for example 2-hydroxy-3-N-phenylcarbamoylnaphthalene and 2-methoxyacetylacetanilide.

The proportions in which the cyclic diazo components and the coupling components are used are not critical, although it is preferred to use the cyclic diazo components and the coupling components in equimolar amounts.

Both the cyclic diazo components and the coupling components can be used on their own or as mixtures with one another in the heat-sensitive recording material.

The shade of the printed image obtained when using heat-sensitive recording materials of the invention can be yellow, orange, pink, red or violet, according to the coupling components used, and the colour images are sharp and clear.

The heat-sensitive recording materials of the invention are used, for instance, for recording information, for example in computers, teleprinters and telex machines, or in recording equipment and measuring instruments, for example electrocardiographs. Image production (marking) can also be effected by hand with a heated pen. Laser beams represent another way of producing markings by means of heat.

The heat-sensitive recording systems contain at least one support, for example paper, synthetic paper or an artificial film, and, formed on top of the said support or supports, one or more temperature-sensitive layers containing the cyclic diazo component and the coupling component.

Meltable film-forming binders are preferably used to prepare the heat-sensitive recording material. These binders are normally watersoluble, whereas the diazo component and the coupling component are insoluble in water. The binder should be capable of dispersing and fixing the diazo and coupling components at room temperature.

Under the action of heat, the binder softens or melts so that the diazo component comes into contact with the coupling component and a colour is formed through coupling. Examples of binders which can dissolve or at least swell in water are hydrophilic polymers such as polyvinyl alcohol, polyacrylic acid, hydroxyethyl cellulose, methyl cellulose, carboxymethyl cellulose, polyacrylamide, polyvinylpyrrolidone, carboxylated butadiene/styrene copolymers, gelatin, starch or etherified cornstarch.

If the diazo component and the coupling component are in two separate layers, it is possible to use water-insoluble binders, i.e. binders soluble in non-polar or only weakly polar solvents, for example natural rubber, synthetic rubber, chlorinated rubber, alkyd resins, polystyrene, styrene/butadiene copolymers, polymethacrylates, ethyl cellulose, nitrocellulose and polyvinylcarbazole. The preferred arrangement, however, is that in which the diazo component and the coupling component are contained in one layer in a water-soluble binder.

The heat-sensitive layers can contain further additives. To improve the degree of whiteness, facilitate printing of the papers and prevent the heated pen from sticking, these layers can contain, for example, talc, titanium dioxide, zinc oxide, aluminium oxide, aluminium hydroxide, calcium carbonate (for example chalk), silica, clays or organic pigments such as urea/formaldehyde polymers. To ensure that the colour is only formed within a limited temperature range, it is possible to add substances such as urea, thiourea, diphenylthiourea, acetamide, acetanilide, benzenesulfanilide, stearamide, phthalic anhydride, metal stearates, for example zinc stearate, phthalonitrile, dimethyl terephthalate or other appropriate meltable products which induce coupling of the cyclic diazo component with the coupling component. The thermographic recording materials preferably contain waxes, for example carnauba wax, montan wax, paraffin wax, polyethylene wax, condensation products of higher fatty acid amides and formaldehydes and condensation products of higher fatty acids and ethylenediamine. If desired, the recording materials can also contain alkaline materials such as alkali metal hydroxides or carbonates or, preferably, open-chain or cyclic organic bases such as amines, alkanolamines, guanidines, pyridines or imidazole derivatives.

In the following Examples, parts and percentages are by weight unless indicated otherwise.

Example 1:

To prepare a dispersion A, the following are ground by means of glass spheres to a particle size of 2–4 μm: 2.25 g of the cyclic diazo component of the formula

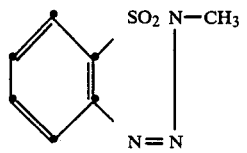

(4)

7.9 g of a 10% aqueous solution of polyvinyl alcohol (Polyviol V03/140)
and
4.5 g of water.

To prepare a dispersion B, the following are ground by means of glass spheres to a particle size of 2–4 μm: 3.0 g of the coupling component of the formula

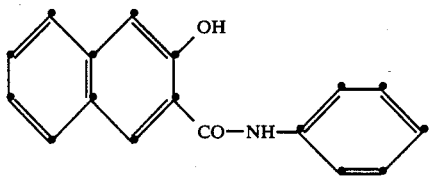

(21)

10.5 g of a 10% aqueous solution of polyvinyl alcohol (Polyviol V03/ 140) and
6.0 g of water.

The two dispersions are then mixed.

The mixture is applied by means of a blade to a paper weighing 50 g/m$^2$.

The amount of material applied is 5 g/m$^2$ (dry weight).

On development with a hotplate (contact time 0.1 second), a red shade quickly develops above 100° C., its full tinctorial strength being reached at 200° C.

Example 2:

If the compound of formula (4) described in Example 1 is replaced by 2.95 g of a diazo component of the formula

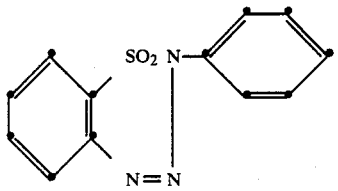

(5)

and the procedure is otherwise as described in Example 1, an intense red colouration with excellent lightfastness is obtained.

Example 3:

If the compound of formula (4) described in Example 1 is replaced in dispersion A by the compound of formula (5) according to Example 2, and the coupling component of formula (21) is replaced in dispersion B by 2.35 g of a coupling component of the formula

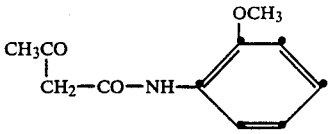

(22)

and the procedure is otherwise as described in Example 1, an intense yellow colouration is obtained.

Corresponding intense and lightfast red or yellow colourations are obtained if the diazo components of the formula

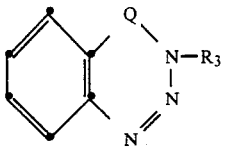

(6)

listed in the following Table are used in Examples 1 to 3 instead of the diazo component used above.

TABLE

| Example | Q | $R_3$ |
|---|---|---|
| 4 | $-SO_2-$ | n-butyl |
| 5 | $-SO_2-$ | cyclohexyl |
| 6 | $-SO_2-$ | benzyl |
| 7 | $-CO-$ | hydrogen |
| 8 | $-CO-$ | methyl |
| 9 | $-CO-$ | n-butyl |
| 10 | $-CO-$ | phenyl |
| 11 | $-CO-$ | benzyl |
| 12 | $-CO-$ | $-CH_2CN$ |
| 13 | $-CO-$ | $-CH_2CH_2OH$ |
| 14 | $-CO-$ | $-CH_2COOCH_3$ |
| 15 | $-CO-$ | $-CH_2OH$ |
| 16 | $-CO-$ | pyrid-2-yl |
| 17 | $-SO_2-$ | 2-methylphenyl |
| 18 | $-SO_2-$ | furfuryl |
| 19 | $-SO_2-$ | pyrid-2-yl |
| 20 | $-SO_2-$ | $-CH_2-CH=CH_2$ |
| 21 | $-CH_2-$ | benzyl |
| 22 | $-CH_2-$ | phenyl |
| 23 | $-CO-$ | $-CH=CH_2$ |
| 24 | $-CO-$ | $-CH_2-CH_2OSO_2CH_3$ |
| 25 | $-CO-$ | 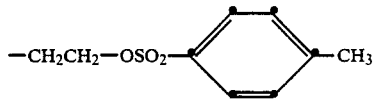 |
| 26 | $-CO-$ | $-OCOCH_3$ |
| 27 | $-CO-$ | 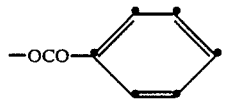 |
| 28 | $-CO-$ | $-OH$ |

What is claimed is:

1. A heat-sensitive recording material comprising a support and, on top of the said support, a heat-sensitive layer comprising a cyclic diazo component in sufficient quantity amount to react with coupling component to form color by coupling under the action of heat and a coupling component, in sufficient quantity amount to react with the cyclic diazo component to form an azo dye, said coupling component does not contain any acid group conferring solubility in water, and said diazo component and said coupling component being in admixture in a layer or alternatively in separate layers wherein heat enables color to form by coupling wherein the cyclic diazo component is a benzotriazine compound of the formula

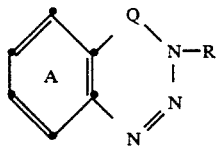

(1)

wherein

Q is —$CH_2$—, —CO— or —$SO_2$—,

R is hydrogen, hydroxy, or alkyl or alkenyl having at most 12 carbon atoms, each unsubstituted or substituted by halogen, hydroxyl, cyano, lower alkoxy, lower alkylthio, $C_1$–$C_8$-acyloxy, lower alkoxycarbonyl or lower alkylsulfonyl, or is acyl, acyloxy or acylamino each having 1 to 10 carbon atoms, or cycloalkyl having 5 to 10 carbon atoms, or phenyl, phenylalkyl or naphthyl, each unsubstituted or ring-substituted by cyano, halogen, nitro, trifluoromethyl, lower alkyl, lower alkylthio, lower alkoxy, lower alkylcarbonyl or lower alkoxycarbonyl, or is a heterocyclic radical, and the benzene ring A is unsubstituted or substituted by halogen, cyano, nitro, lower alkyl, lower alkoxy, lower alkylthio, lower alkylcarbonyl or lower alkoxycarbonyl.

2. A recording material according to claim 1, wherein R in formula (1) is lower alkyl, hydroxy-lower alkyl, cyano-lower alkyl, acetyl, acetylamino, benzoyl, cyclohexyl, benzyl, phenyl, chlorophenyl, tolyl, xylyl, naphthyl, methoxyphenyl, pyridyl or furfuryl.

3. A recording material according to claim 1, wherein R in formula (1) is hydroxyl, acetoxy, benzoyloxy, vinyl, methylsulfonyloxyethyl or tolylsulfonyloxyethyl.

4. A recording material according to claim 1, wherein Q is —CO— or —$SO_2$—.

5. A recording material according to claim 1, wherein the benzene ring A in formula (1) is unsubstituted or substituted by halogen, nitro, lower alkyl, lower alkoxy or lower alkoxycarbonyl.

6. A recording material according to claim 1, wherein the cyclic diazo component has the formula

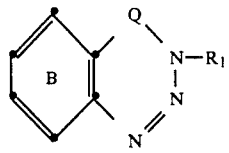

(2)

wherein

Q is —CO— or —$SO_2$—, $R_1$ is lower alkyl, halogeno-lower alkyl, hydroxy-lower alkyl, cyanolower alkyl, lower alkoxy-carbonyl-lower alkyl, cyclohexyl, benzyl, naphthyl, phenyl or phenyl substituted by halogen, cyano, nitro, lower alkyl, lower alkoxy, trifluoromethyl or lower alkylcarbonyl, or is a heterocyclic radical of aromatic character, and the benzene ring B is unsubstituted or substituted by halogen, nitro, lower alkyl, lower alkoxy or lower alkoxycarbonyl.

7. A recording material according to claim 6, wherein $R_1$ in formula (2) is lower alkyl, cyclohexyl, benzyl, phenyl or phenyl substituted by halogen, lower alkyl or lower alkoxy, and the benzene ring B is unsubstituted or substituted by halogen.

8. A recording material according to claim 1, wherein the cyclic diazo component has the formula

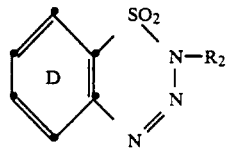

(3)

wherein $R_2$ is lower alkyl, cyclohexyl, benzyl, phenyl or phenyl substituted by halogen, methyl or methoxy, and the benzene ring D is unsubstituted or substituted by halogen.

9. A recording material according to claim 1, wherein the coupling component is a naphthol, naphtholcarboxylic acid anilide or acylacetarylamide compound.

10. A recording material according to claim 1, which contains, in addition to the diazo and coupling components, at least one binder in at least one layer.

* * * * *